US010561907B2

(12) United States Patent
Yamamoto

(10) Patent No.: US 10,561,907 B2
(45) Date of Patent: Feb. 18, 2020

(54) RACKET FRAME

(71) Applicant: SUMITOMO RUBBER INDUSTRIES, LTD., Kobe-shi, Hyogo (JP)

(72) Inventor: Yosuke Yamamoto, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 16/206,663

(22) Filed: Nov. 30, 2018

(65) Prior Publication Data

US 2019/0184243 A1 Jun. 20, 2019

(30) Foreign Application Priority Data

Dec. 15, 2017 (JP) ..... 2017-240377

(51) Int. Cl.

| | |
|---|---|
| ***A63B 49/02*** | (2015.01) |
| ***A63B 49/14*** | (2015.01) |
| ***A63B 49/08*** | (2015.01) |
| ***A63B 49/10*** | (2015.01) |
| ***A63B 60/52*** | (2015.01) |
| ***A63B 49/022*** | (2015.01) |
| ***A63B 60/54*** | (2015.01) |
| ***A63B 60/48*** | (2015.01) |
| *A63B 102/02* | (2015.01) |

(52) U.S. Cl.

CPC ..... *A63B 49/14* (2013.01); *A63B 49/02* (2013.01); *A63B 49/022* (2015.10); *A63B 49/08* (2013.01); *A63B 49/10* (2013.01); *A63B 60/48* (2015.10); *A63B 60/52* (2015.10); *A63B 60/54* (2015.10); *A63B 2049/0201* (2015.10); *A63B 2102/02* (2015.10); *A63B 2209/02* (2013.01); *A63B 2209/023* (2013.01)

(58) Field of Classification Search

CPC ..... A63B 49/02; A63B 49/022; A63B 51/06; A63B 49/08; A63B 49/10; A63B 49/14; A63B 60/48; A63B 60/52; A63B 60/54; A63B 2209/02; A63B 2209/023; A63B 2049/0201; A63B 2102/02

See application file for complete search history.

(56) References Cited

U.S. PATENT DOCUMENTS 5,209,472 A * 5/1993 Tseng ..... A63B 49/022 473/537
5,342,044 A * 8/1994 You ..... A63B 49/02 473/542

(Continued)

FOREIGN PATENT DOCUMENTS

EP 2762205 A1 8/2014
JP 6053539 B2 12/2016

*Primary Examiner* — Raleigh W Chiu
(74) *Attorney, Agent, or Firm* — Birch, Stewart, Kolasch & Birch, LLP

(57) ABSTRACT

Provided is a racket frame on which design change can be easily performed by simple processing. The racket frame includes a head formed in a ring shape along a face. On the head, a gut groove in which a base portion for connecting grommets is to be inserted is formed in a radially outer region of the head so as to be recessed toward a radially inner side, and a deformation promotion groove is formed in the radially outer region of the head so as to be recessed toward the radially inner side.

9 Claims, 6 Drawing Sheets

(56) References Cited

U.S. PATENT DOCUMENTS

| | | | | | |
|---|---|---|---|---|---|
| 5,435,550 | A * | 7/1995 | You | A63B 49/022 | 473/542 |
| 5,467,982 | A * | 11/1995 | Tseng | A63B 49/02 | 473/540 |
| 5,743,822 | A * | 4/1998 | Tarleton | A63B 49/022 | 473/533 |
| 6,254,499 | B1 * | 7/2001 | Tarleton | A63B 51/06 | 473/533 |
| 6,764,417 | B1 * | 7/2004 | Filippini | A63B 49/022 | 473/540 |
| 7,887,444 | B1 * | 2/2011 | Severa | A63B 49/10 | 473/539 |
| 2006/0172827 | A1 * | 8/2006 | Soekahar | A63B 49/022 | 473/520 |
| 2010/0285908 | A1 * | 11/2010 | Chang | A63B 60/54 | 473/522 |
| 2018/0078828 | A1 * | 3/2018 | Valbousquet | A63B 49/02 | |

* cited by examiner

RACKET FRAME

BACKGROUND OF THE INVENTION

Field of the Invention

The present invention relates to racket frames for use in tennis, etc.

Description of the Related Art

Hitherto, a type of a racket frame of which deformation is promoted when a player hits a ball on the face of a racket has been proposed as a racket frame for use in tennis, etc. As such a racket frame, there is one disclosed in JP Patent No. 6053539.

JP Patent No. 6053539 discloses a racket frame in which the compression elastic modulus of each side reinforcing layer is set so as to be lower than the compression elastic modulus of a top reinforcing layer, thereby promoting deformation of the racket frame. JP Patent No. 6053539 indicates that, when a player hits a ball at a portion other than the sweet spot of a racket, the shock upon hitting the ball is alleviated by deformation of the racket frame, and the ball is launched at a high speed due to restoration.

In JP Patent No. 6053539, deformation of the racket frame is positively promoted by making the compression elastic modulus of the top reinforcing layer of the racket frame and the compression elastic modulus of each side reinforcing layer different from each other.

However, in the racket frame disclosed in JP No. Patent 6053539, in order to make the compression elastic modulus of the top reinforcing layer and the compression elastic modulus of each side reinforcing layer different from each other, it is necessary to appropriately select the material for forming the top reinforcing layer and the material for forming each side reinforcing layer. Thus, when the material for forming the top reinforcing layer and the material for forming each side reinforcing layer have been determined and the racket frame has been produced, it is necessary to newly select a material to be used, in order to perform design change later. That is, a lot of time and effort is taken to change the material for design change of the racket frame. Therefore, after the racket frame is produced, it is difficult to perform design change of the racket frame, and there is a possibility that the range of design of the racket frame becomes narrow.

Therefore, in view of the above-described circumstances, an object of the present invention is to provide a racket frame on which design change can be easily performed by simple processing.

SUMMARY OF THE INVENTION

A racket frame according to the present invention includes a head formed in a ring shape along a face, and, on the head, a first groove in which a base portion for connecting grommets is to be inserted is formed in a radially outer region of the head so as to be recessed toward a radially inner side, and a second groove is formed in the radially outer region of the head so as to be recessed toward the radially inner side.

Preferably, the second groove is formed so as to be shallower than the first groove.

In addition, a plurality of the second grooves are formed in a thickness direction, and the first groove is formed so as to be located between the plurality of the second grooves.

Preferably, a grip is attached to the head, and the second groove is formed on a head end portion of the head at a side opposite to a side at which the grip is attached.

According to another aspect of the present invention, in the racket frame, a grip is attached to the head, and the second groove is formed on both end portions of the head in a width direction orthogonal to an axial direction from the grip toward a head end portion at a side opposite to a side at which the grip is attached.

According to still another aspect of the present invention, in the racket frame, a grip is attached to the head, and the second groove is formed on a head end portion of the head at a side opposite to a side at which the grip is attached, and on both end portions of the head in a width direction orthogonal to an axial direction from the grip toward the head end portion in the face.

According to still another aspect of the present invention, in the racket frame, the second groove is formed over an entirety in a circumferential direction of the head.

According to still another aspect of the present invention, in the racket frame, the second groove is formed intermittently along a circumferential direction of the head.

Design change can be easily performed on the racket frame according to the present invention. Thus, the range of design of the racket frame can be expanded, and the production cost of the racket frame can be reduced.

DESCRIPTION OF THE PREFERRED EMBODIMENTS

The following will describe a racket frame according to an embodiment of the present invention with reference to the accompanying drawings.

Figure 1:
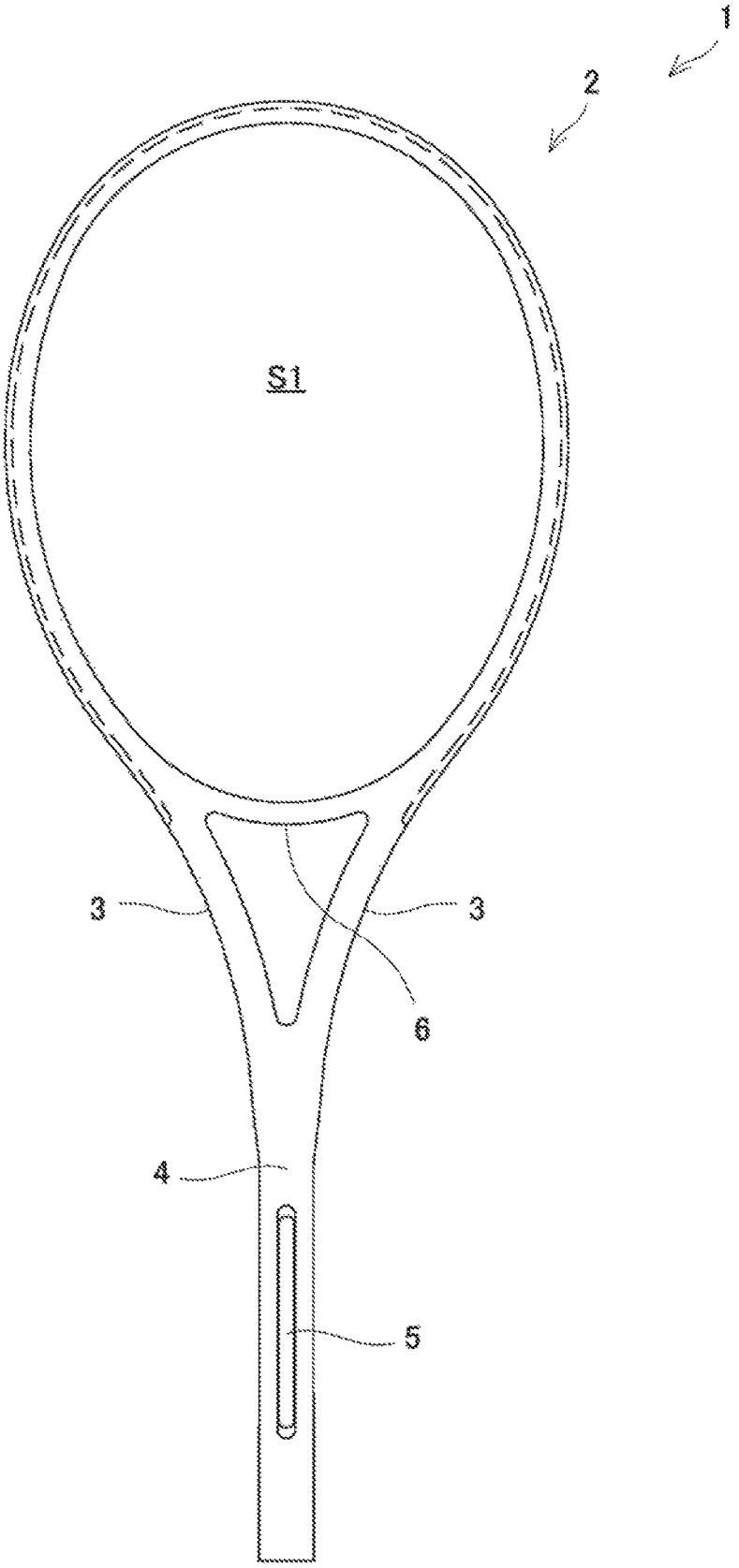
FIG. 1 is a front view of a racket frame according to an embodiment of the present invention.

FIG. 1 shows a front view of the racket frame according to the embodiment of the present invention. In addition, FIG. 2 shows a side view of the racket frame according to the embodiment of the present invention.

Figure 2:
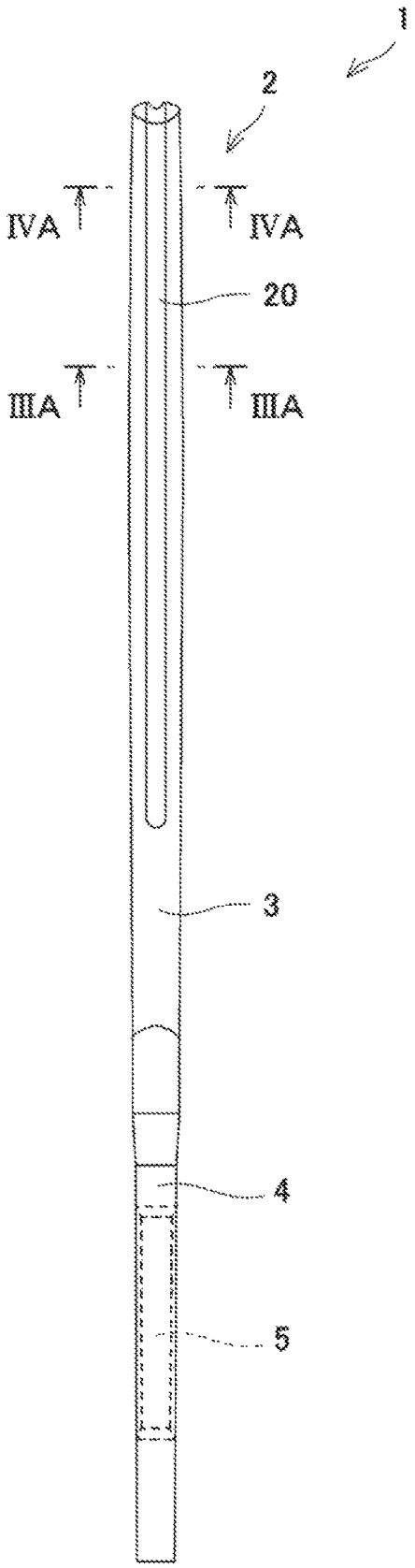
FIG. 2 is a side view of the racket frame in FIG. 1.

The racket frame 1 shown in FIGS. 1 and 2 includes a head 2, two throats 3, a shaft 4, and a grip 5. Grommets, a grip tape, an end cap, etc., are attached to the racket frame 1, and a string (gut) is stretched on the racket frame 1, whereby a racket for regulation-ball tennis is obtained. In FIG. 1, the up-down direction is the axial direction of the racket frame 1, and the right-left direction is the width direction of the racket frame 1. In FIG. 2, the right-left direction is the thickness direction of the racket frame 1.

The racket frame 1 is formed from a fiber reinforced resin. The matrix resin of the fiber reinforced resin is a thermosetting resin. The thermosetting resin is typically an epoxy resin. The fibers of the fiber reinforced resin are typically carbon fibers. The fibers are long fibers. The racket frame 1 is shaped by winding a plurality of prepregs and curing the thermosetting resin included in the prepregs.

The head 2 forms the contour of a face S1. The face S1 is a surface on which the string is stretched. By hitting a ball on the string stretched on the face S1 to rebound the ball, the ball is launched. The front shape of the head 2 is substantially an ellipse. Therefore, the head 2 is formed in a ring shape along the face S1. The major axis direction of the ellipse coincides with the axial direction of the racket frame 1. The minor axis direction of the ellipse coincides with the width direction of the racket frame 1. One end of each throat 3 is connected to the head 2. Each throat 3 is connected at the vicinity of the other end thereof to the other throat 3. The throats 3 extend from the head 2 to the shaft 4. The shaft 4 extends from the location where the two throats 3 are connected to each other. The shaft 4 is formed so as to be integrally connected to the throats 3. The grip 5 is formed so as to be integrally connected to the shaft 4. A portion of the head 2 that is located between the two throats 3 is a yoke 6.

Figure 3A:
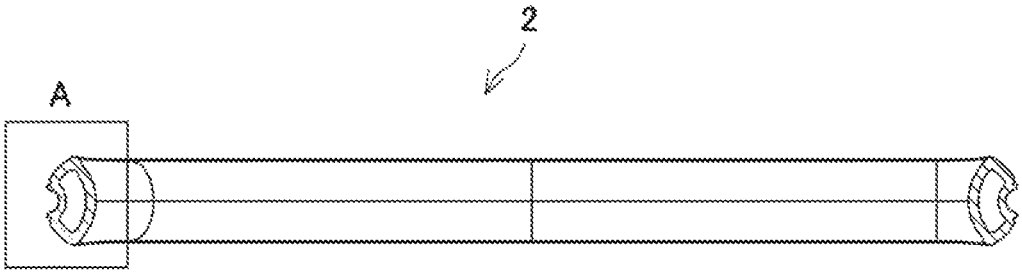
FIG. 3A is a cross-sectional view of the racket frame in FIG. 2, taken along an IIIA-IIIA line.
Figure 3B:
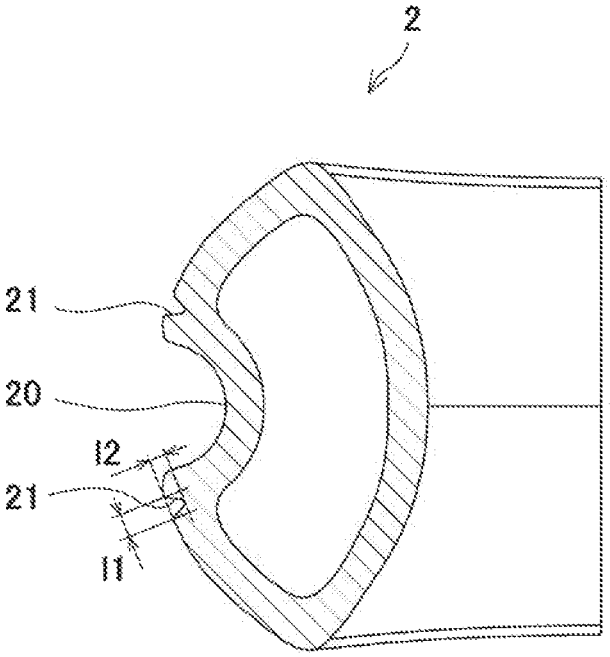
FIG. 3B is an enlarged cross-sectional view of a portion A in FIG. 3A.

FIG. 3A is a cross-sectional view showing a cross-section taken along an IIIA-IIIA line in FIG. 2, and FIG. 3B shows an enlarged cross-sectional view of a portion A in the racket frame 1 in FIG. 3A. In FIG. 3B, the left side is the outer side of the head 2, and the right side is the inner side of the head 2. As shown in FIG. 3B, the racket frame 1 is formed so as to be hollow. At the position shown in FIGS. 3A and 3B in the racket frame 1, no grommet and no string are provided.

As shown in FIGS. 3A and 3B, a gut groove (first groove) 20 is formed on the head 2. The gut groove 20 is formed in a radially outer region of the head 2 so as to be recessed toward the radially inner side. In the present embodiment, the gut groove 20 is formed on the outer surface of the head 2 along the circumferential direction of the head 2. As described later, a plurality of grommets and a base portion for connecting the grommets are inserted into the gut groove 20. As shown in FIG. 2, the gut groove 20 extends along the circumferential direction of the head 2. In the present embodiment, the gut groove 20 is formed over the entire circumference in the circumferential direction of the head 2.

As shown in FIG. 3B, in addition to the gut groove 20, a deformation promotion groove (second groove) 21 for promoting deformation of the head 2 is formed on the head 2. The deformation promotion groove 21 is formed in the radially outer region of the head 2 so as to be recessed toward the radially inner side. The deformation promotion groove 21 is formed on the outer surface of the head 2 along the circumferential direction of the head 2. In addition, at least one deformation promotion groove 21 is formed at each of both sides of the gut groove 20 in the thickness direction such that the gut groove 20 is located therebetween. In the present embodiment, two deformation promotion grooves 21 are formed in the thickness direction of the racket frame 1, and the gut groove 20 is formed at a position between the two deformation promotion grooves 21 along the thickness direction in the racket frame 1.

As for optimum dimensions of each deformation promotion groove 21, a width 11 shown in FIG. 3B is 1.0 mm, and a depth 12 shown in FIG. 3B is 0.5 mm.

In addition, as for conceivable ranges for the dimensions of the deformation promotion grooves 21, the width 11 shown in FIG. 3B is 0.5 mm to 1.5 mm, and the depth 12 shown in FIG. 3B is 0.3 mm to 1.0 mm.

As described above, in the present embodiment, a plurality of deformation promotion grooves 21 are formed in the thickness direction. The gut groove 20 is formed so as to be located between the plurality of deformation promotion grooves 21 formed in the thickness direction. Moreover, the deformation promotion grooves 21 are formed so as to be shallower than the gut groove 20.

Figure 4A:
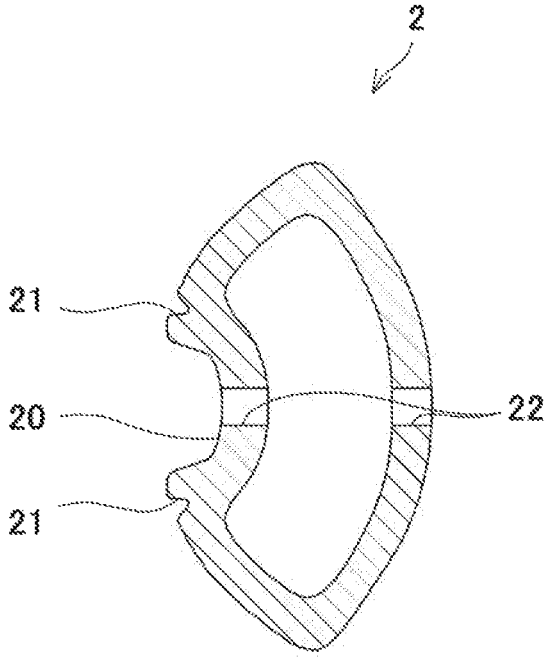
FIG. 4A is a cross-sectional view of a portion of the racket frame in FIG. 1, in which a string is to be passed, in a state where no grommet and no string are attached.
Figure 4B:
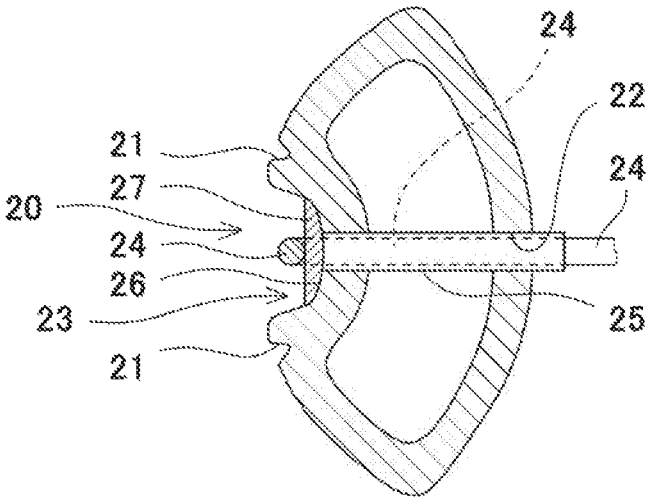
FIG. 4B is a cross-sectional view in a state where a grommet and a string are attached to a head portion in FIG. 4A.

FIGS. 4A and 4B each show an enlarged cross-sectional view of the racket frame 1, taken along an IVA-IVA line in FIG. 2.

FIGS. 4A and 4B each show a cross-sectional view of a portion of the racket frame 1 in which a string 24 is to be passed. FIG. 4A shows a cross-sectional view of the racket frame 1 in a state where no grommet and no string are attached.

As shown in FIG. 4A, at the position at which a grommet 23 is to be attached, a passage 22 for disposing the grommet 23 is formed in the head 2 so as to penetrate the head 2.

FIG. 4B shows a cross-sectional view of the racket frame 1 in a state where the grommet 23 and the string 24 are attached. As shown in FIG. 4B, the grommet 23 is configured to have a pipe 25 and a part, in the circumferential direction, of a base portion 27.

The pipe 25 is disposed within the passage 22, which is formed so as to penetrate the head 2. In a state where the grommet 23 and the string 24 are provided to the head 2, the pipe 25 is disposed inside the passage 22. The string 24 is disposed so as to extend through the interior of the pipe 25 toward the radially inner side of the face S1.

The base portion 27 is disposed outside the head 2 so as to connect a plurality of grommets 23 disposed along the circumferential direction. The base portion 27 has a band shape and is disposed within the gut groove 20 along the circumferential direction so as to be in contact with a bottom surface 26 of the gut groove 20.

A plurality of strings 24 are disposed along the circumferential direction of the face S1 in the head 2. The strings 24 are attached at the respective positions thereof along the circumferential direction so as to extend toward the inner side such that the face S1 is formed. The plurality of grommets 23 are disposed along the circumferential direction of the face S1 in the head 2 in corresponding relation to the respective strings 24 extending toward the inner side.

Moreover, the string 24 is disposed so as to extend along the circumferential direction at a position on the radially outer side of the base portion 27 within the gut groove 20. The string 24 extending inward, at the position at which the grommet 23 is attached, such that the face S1 is formed, is disposed so as to extend along the circumferential direction at the position on the outer side of the base portion 27 and further extend toward the inner side at the position of the next grommet 23. Therefore, the string 24 has: a portion disposed so as to extend toward the inner side such that the face S1 is formed; and a portion disposed along the circumferential direction at the outer side of the base portion 27.

Since the base portion 27 for connecting the plurality of grommets 23 disposed along the circumferential direction is disposed on the side surface of the head 2 at the radially outer side, the base portion 27 is located at a position on the radially outer side of the face S1. Thus, the base portion 27 connects the plurality of grommets arranged along the circumferential direction of the face S1 in the head 2.

When a tennis ball is hit by a tennis racket in which the racket frame 1 is used, the tennis ball is rebounded on the face S1, whereby the tennis ball is launched. At this time, the string 24 is bent, whereby the string 24 is pulled toward the inner side. Thus, tensile force toward the inner side is applied to the string 24.

Figure 5:
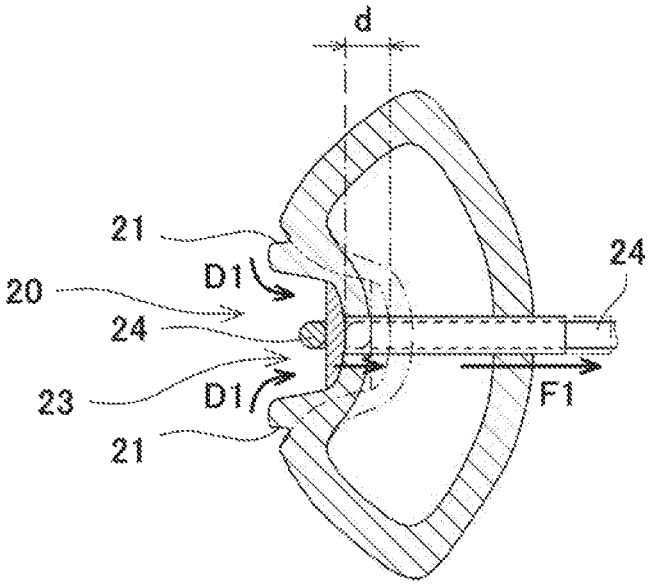
FIG. 5 is a cross-sectional view of the racket frame in FIG. 4B when the racket frame is deformed by the string being pulled toward the inner side.

FIG. 5 shows a cross-sectional view of the head 2 when a tennis ball is hit by the face S1 of the racket frame 1. When the tennis ball is hit by the face S1 of the racket frame 1, the string 24 is pulled, at the time of impact, rearward in the direction in which the racket frame 1 is swung. Therefore, the string 24 is pulled, at the hitting spot, rearward in the thickness direction of the racket frame 1. Accordingly, in the vicinity of the position at which the string 24 is attached to the racket frame 1, the string 24 is pulled in the direction toward the inner side in the face S1. Thus, tensile force F1 shown in FIG. 5 is applied to the string 24.

When a tennis ball is hit at or near the sweet spot in the face S1, the string 24 is sufficiently stretched in the direction toward the inner side by the tensile force F1 toward the inner side. By the stretching of the string 24, the shock applied to the racket frame 1 is absorbed. In addition, after the stretching, the string 24 becomes restored. By the restoring force at the time of restoration, the tennis ball is launched at a high speed from the racket frame 1.

On the other hand, when a tennis ball is hit at a position away from the sweet spot, there is a possibility that stretching of the string 24 is not sufficient. When a tennis ball is hit at a position, in the face S1, which is away from the sweet spot and close to the racket frame 1, the distance from the hitting spot to the position at which the string 24 is attached to the racket frame 1 is short. Therefore, even when the string 24 is pulled toward the inner side due to the hit and the tensile force F1 is applied to the string 24, the length for stretching of the string 24 is not sufficient, and thus there is a possibility that the stretching of the string 24 is not sufficient. Therefore, when a tennis ball is hit at a position away from the sweet spot, stretching of the string 24 is insufficient, and thus there is a possibility that the tennis ball is insufficiently rebounded.

In the present embodiment, in addition to the gut groove 20, the deformation promotion grooves 21 are formed on the head 2 of the racket frame 1 and at both sides of the gut groove 20 such that the gut groove 20 is located therebetween. Since the deformation promotion grooves 21 are formed on the head 2, the head 2 has a shape that allows the head 2 to easily deform by the tensile force F1 when the tensile force F1 is applied to the string 24.

When the tensile force F1 is applied to the string 24, regions closer to the gut groove 20 than to the deformation promotion grooves 21 are deformed in directions indicated by arrow D1 as shown in FIG. 5. Accordingly, the head 2 is deformed into a shape shown by broken lines in FIG. 5. At this time, stress due to the tensile force F1 is concentrated on the deformation promotion grooves 21, and thus the head 2 is relatively easily deformed. Since the head 2 is deformed as shown by the broken lines in FIG. 5, the position of the grommet 23 at which the string 24 is attached to the head 2 is shifted inward by a distance d shown in FIG. 5.

Since the head 2 is deformed as described above, even when stretching of the string 24 is insufficient, deformation of the head 2 can make up for the insufficient stretching of the string 24. Since a deficiency in stretching of the string 24 is made up for by deformation of the head 2, when shock is applied to the racket frame 1, the string 24 is sufficiently displaced. The shock at the time when a tennis ball collides against the face S1 is absorbed by displacement of the string 24, so that shock applied to the racket frame 1 is alleviated. The player can completely swing the racket while maintaining the direction of the ball-hitting face.

Even when restoration of the string 24 is insufficient, the head 2 is deformed, and is restored from the deformation so as to make up for a deficiency in stretching of the string 24. By the restoring force applied supplementally by the restoration of the head 2, the tennis ball is launched at a high speed from the racket frame 1.

In the racket frame 1, deformation of the head 2 can make up for insufficient stretching of the string 24 when a tennis ball is hit at a position away from the sweet spot. As described above, the racket frame 1 has excellent shock absorption, operability, and resilience when a tennis ball is hit at a position away from the sweet spot. In addition, even when a tennis ball is hit at a position away from the sweet spot, shock applied to the racket frame 1 at the time when the tennis ball collides against the face S1 is alleviated, and the resilience is maintained to be high. Thus, as a result, the sweet area of the racket frame 1 can be widened.

As described above, when a tennis ball is hit at or near the sweet spot, the string 24 sufficiently stretches. Therefore, only by the stretching of the string 24, shock applied to the racket frame 1 at the time when the tennis ball collides against the face S1 is alleviated, and the resilience can be maintained high. Thus, in this case as well, the racket frame 1 has excellent shock absorption, operability, and resilience when a tennis ball is hit.

The deformation promotion groove 21 may be formed at any position. Specifically, the deformation promotion groove 21 may be formed at any position on the head 2 as long as the deformation promotion groove 21 is formed at a position different from that of the gut groove 20 and can promote deformation of the head 2.

For example, the deformation promotion groove 21 may be formed in a region including a top position in the up-down direction of the racket frame 1. That is, the deformation promotion groove 21 may be formed in a certain region around the top position. Here, an end portion of the head 2 at the side opposite to the side at which the throats 3, the shaft 4, and the grip 5 are provided in the racket frame 1 is referred to as a top position (head end portion) of the head 2.

For example, the deformation promotion groove 21 may be formed in regions including both end portions of the head 2 in the width direction orthogonal to the axial direction of the racket frame 1 from the grip 5 toward the top position. That is, the deformation promotion groove 21 may be formed in certain regions around both end portions in the width direction of the racket frame 1.

For example, the deformation promotion groove 21 may be formed in both the region including the top position and the regions including both end portions in the width direction, on the head 2. That is, the deformation promotion groove 21 may be formed in both a certain region around the top position of the racket frame 1 and certain regions around both end portions in the width direction of the racket frame 1.

For example, the deformation promotion groove 21 may be formed over the entirety in the circumferential direction on the head 2. The deformation promotion groove 21 may be formed continuously on the outer surface along the circumferential direction of the head 2 over the entirety in the circumferential direction.

For example, the deformation promotion groove 21 may be formed intermittently along the circumferential direction of the head 2.

The string 24 has strings used as longitudinal strings and strings used as lateral strings. As described above, the front shape of the head 2 is substantially an ellipse, and the major axis direction of the ellipse coincides with the axial direction of the racket frame 1. Therefore, the length of the average longitudinal string is larger than the length of the average lateral string. In general, the longitudinal strings stretch more easily than the lateral strings.

In order to make up for a deficiency in the degree of stretching of the lateral strings, the deformation promotion groove 21 may be provided only around the portions to which the lateral strings are attached. Accordingly, only the regions of the head 2 around the portions to which the lateral strings are attached can be easily deformed. Therefore, the insufficient degree of stretching of the lateral strings can be made up for.

In order to make up for a deficiency in the degree of stretching of the lateral strings, a depth difference may be produced between the deformation promotion groove 21 formed around the portions to which the lateral strings are attached and the deformation promotion groove 21 formed around the portions to which the longitudinal strings are attached. That is, the depth of the deformation promotion groove 21 formed around the portions to which the lateral strings are attached may be set so as to be larger than the depth of the deformation promotion groove 21 formed around the portions to which the longitudinal strings are attached. Accordingly, in the head 2, the regions around the portions to which the lateral strings are attached can be more easily deformed than the regions around the portions to which the longitudinal strings are attached. Thus, a deficiency in the degree of stretching of the lateral strings around the portions to which the lateral strings are attached can be made up for.

The depth of one deformation promotion groove 21 does not have to be uniform.

The width of one deformation promotion groove 21 does not have to be uniform.

The deformation promotion groove 21 does not have to have a straight shape and may have a line shape such a wavy line shape or a zigzag shape.

In the above embodiment, the racket frame which is configured such that the two deformation promotion grooves 21 are formed in the thickness direction and the gut groove 20 is located between the deformation promotion grooves 21, has been described. The present invention is not limited to the above embodiment. The deformation promotion groove 21 may be formed only at either side of the gut groove 20, that is, only one deformation promotion groove 21 may be formed in the thickness direction of the racket frame 1. Moreover, three or more deformation promotion grooves 21 may be formed in the thickness direction. The number of deformation promotion grooves 21 formed in the thickness direction may be any number as long as deformation of the head 2 is promoted as a result of formation of the deformation promotion grooves 21 and thus a deficiency in the degree of stretching of the strings can be made up for.

The deformation promotion groove 21 may be formed at the stage when the racket frame 1 is shaped by winding a plurality of prepregs and curing a thermosetting resin, or may be formed by chipping away the surface of the racket frame later.

According to the present embodiment, in the case where the degree of stretching of the string 24 is insufficient, the deformation promotion groove 21 is formed on the head 2, and a deficiency in stretching of the string 24 can be made up for by deformation of the head 2. The deformation promotion groove 21 can be formed by simple processing after the racket frame 1 is produced. Therefore, the deformation promotion groove 21 can be easily formed in the racket frame 1. That is, design change of the racket frame 1 can be easily performed by merely forming the deformation promotion groove 21 without changing the material for forming the racket frame, etc. Therefore, in the case where the resilience coefficient obtained when a ball is hit at a position deviated from the center position is insufficient, design change for making up for the insufficient resilience coefficient can be easily performed on the racket frame 1.

Since design change of the racket frame 1 can be easily performed, the range of design of the racket frame 1 can be expanded. In addition, since design change can be easily performed, the production cost of the racket frame in the case where design change is performed can be reduced.

EXAMPLES

The following will show the effects of the present invention by means of an example, but the present invention should not be construed in a limited manner on the basis of the description of the example.

Example 1

The racket frame shown in FIGS. 1 to 5 was produced. In the racket frame of Example 1, deformation promotion grooves are formed at positions at which strings as lateral strings are attached.

Comparative Example 1

A racket frame of Comparative Example 1 is similar to the racket frame of Example 1, but no deformation promotion groove is formed therein.

The racket frames of Example 1 and Comparative Example 1 were used, tennis balls were launched toward various positions in the faces of the respective racket frames, and resilience coefficients provided when the tennis balls were rebounded on the faces were measured.

The conditions for launching the tennis balls toward the racket frames are as follows.

Tennis Racket

Weight: 300 (g)

Balance (position of center of gravity from grip end): 320 mm

Swing weight: 288 kg·cm$^2$

String: RPM Blast 125

Center surface pressure: 45 (pounds)

Tennis Ball

Ball speed: 30 m/s

Ball type: FORT

As for tennis rackets, two types, that is, a type in which deformation promotion grooves are formed on the outer surfaces of portions of a racket frame to which lateral strings are attached (Example 1) and a type in which no deformation promotion groove is formed in a racket frame (Comparative Example 1), were used.

Tennis balls were launched to various hitting spots on the two types of tennis rackets, and resilience coefficients were measured for the respective hitting spots.

[Evaluation]

Table 1 shows the results of calculation of resilience coefficients for the respective hitting spots with the distance from the top position of the racket changed. In Table 1, resilience coefficients are calculated for each of the tennis racket of Example 1 and the tennis racket of Comparative Example 1. In addition, in Table 1, as for the position in the width direction, resilience coefficients are calculated for the center, a position deviated outward from the center by 3 cm, and a position deviated outward from the center by 6 cm.

TABLE 1

| | | Without groove (Comparative Example 1) | | | With grooves (Example 1) | | |
|---|---|---|---|---|---|---|---|
| | | Distance from top position of racket | | | | | |
| | | 15 | 18 | 21 | 15 | 18 | 21 |
| Position in width direction of racket | Center | 0.354 | 0.392 | 0.405 | 0.343 | 0.383 | 0.395 |
| | 3 cm from center | 0.275 | 0.311 | 0.331 | 0.277 | 0.303 | 0.317 |
| | 6 cm from center | 0.142 | 0.157 | 0.147 | 0.147 | 0.174 | 0.178 |

In addition, Table 2 shows averages calculated for the respective positions in the width direction of the rackets.

TABLE 2

| | | Without groove (Comparative Example 1) | With grooves (Example 1) |
|---|---|---|---|
| Position in width direction of racket | Center | 0.384 | 0.374 |
| | 3 cm from center | 0.306 | 0.299 |
| | 6 cm from center | 0.149 | 0.166 |

As shown in Table 2, upon hitting at the position deviated outward from the center by 6 cm, the resilience coefficient of the type of tennis racket of Example 1 having the deformation promotion grooves is higher than that of the type of tennis racket of Comparative Example 1 having no deformation promotion groove. In this test, at the position deviated from the center by 6 cm, the resilience coefficient of the tennis racket of Example 1 is higher than that of the tennis racket of Comparative Example 1 by 12%. From this result, the resilience when a tennis ball is hit at a position deviated from the center is increased by forming the deformation promotion grooves.

Figure 6:
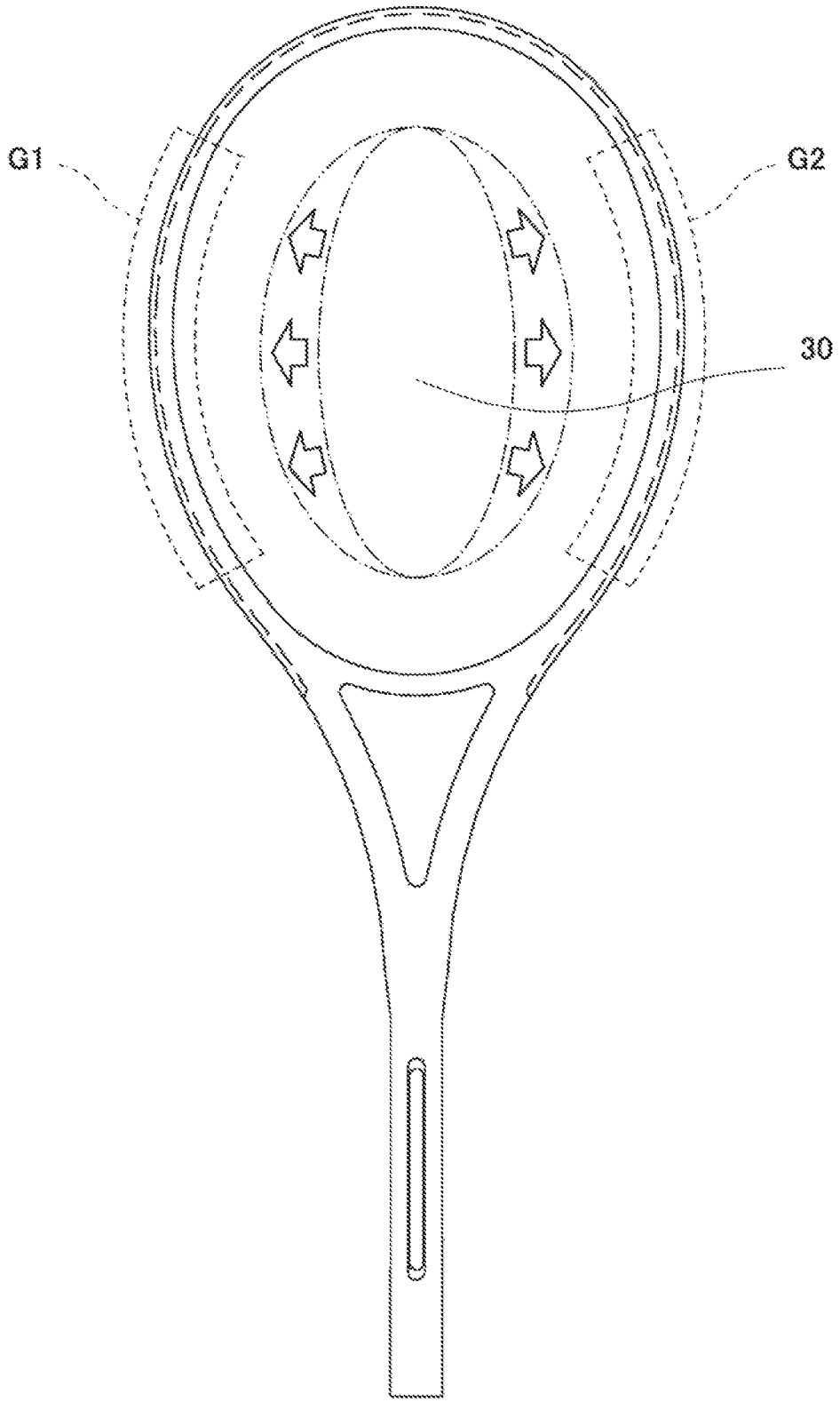
FIG. 6 is a configuration diagram showing a sweet spot expanded by forming deformation promotion grooves in a racket frame according to Example 1 of the present invention.

Therefore, as shown in FIG. 6, a sweet area 30 of the racket frame can be widened by forming the deformation promotion grooves. In the racket frame of Example 1, since the deformation promotion grooves are formed in regions G1 and G2 surrounded by broken lines, that is, at the positions at which strings as lateral strings are attached, the sweet area 30 is expanded in the lateral direction of the racket frame.

Therefore, even when a tennis ball is hit at a position deviated from the center position on the face of the racket frame, the tennis ball can be launched at a high speed since the resilience is maintained to be high at this portion. From the evaluation results, advantages of the present invention are clear.

What is claimed is:

1. A racket frame comprising a head formed in a ring shape along a face, wherein on the head, a first groove in which a base portion for connecting grommets is to be inserted is formed in a radially outer region of the head so as to be recessed toward a radially inner side, a second groove is formed in the radially outer region of the head so as to be recessed toward the radially inner side, and the racket frame is configured in such a manner that when a force toward the radially inner side is applied to a bottom surface of the first groove, the second groove promotes deformation of the head, such that the bottom surface of the first groove shifts toward the radially inner side.

2. The racket frame according to claim 1, wherein the second groove is formed so as to be shallower than the first groove.

3. The racket frame according to claim 1, wherein a plurality of the second grooves are formed in a thickness direction, and the first groove is formed so as to be located between the plurality of the second grooves.

4. The racket frame according to claim 1, wherein a grip is attached to the head, and the second groove is formed on a head end portion of the head at a side opposite to a side at which the grip is attached.

5. The racket frame according to claim 1, wherein a grip is attached to the head, and the second groove is formed on both end portions of the head in a width direction orthogonal to an axial direction from the grip toward a head end portion at a side opposite to a side at which the grip is attached.

6. The racket frame according to claim 1, wherein a grip is attached to the head, and the second groove is formed on a head end portion of the head at a side opposite to a side at which the grip is attached, and on both end portions of the head in a width direction orthogonal to an axial direction from the grip toward the head end portion in the face.

7. The racket frame according to claim 1, wherein the second groove is formed over an entirety in a circumferential direction of the head.

8. The racket frame according to claim 1, wherein the second groove is formed intermittently along a circumferential direction of the head.

9. The racket frame according to claim 1, wherein a grip is attached to the head, and the second groove is formed so as to be shallower than the first groove, the second groove being formed on both end portions of the head in a width direction orthogonal to an axial direction from the grip toward a head end portion at a side opposite to a side at which the grip is attached.

* * * * *